US012752151B2

(12) United States Patent
Dreissigacker et al.

(10) Patent No.: US 12,752,151 B2
(45) Date of Patent: Oct. 6, 2026

(54) EXERCISE DEVICE WITH ALTERNATIVE PUSH AND PULL FUNCTIONALITY

(71) Applicant: Concept2, Inc., Morrisville, VT (US)

(72) Inventors: Richard Alan Dreissigacker, Craftsbury, VT (US); Peter Dan Dreissigacker, Stowe, VT (US); Kevin Daniel Stevenson, Morrisville, VT (US); Cody Grey Spiegel, Hinesburg, VT (US); Daniel Caleb Brooks, Pittsfield, MA (US); Elizabeth Scott Ferraro, North Danfield, VT (US); Christopher Michael LeBlanc, Morrisville, VT (US)

(73) Assignee: CONCEPT2, INC., Morrisville, VT (US)

( * ) Notice: Subject to any disclaimer, the term of this patent is extended or adjusted under 35 U.S.C. 154(b) by 64 days.

(21) Appl. No.: 18/917,495

(22) Filed: Oct. 16, 2024

(65) Prior Publication Data

US 2026/0102650 A1 Apr. 16, 2026

(51) Int. Cl.
*A63B 22/00* (2006.01)
*A63B 22/20* (2006.01)

(52) U.S. Cl.
CPC ..... *A63B 22/0076* (2013.01); *A63B 22/0087* (2013.01); *A63B 22/203* (2013.01); *A63B 2022/0079* (2013.01)

(58) Field of Classification Search
CPC .... A63B 22/0076–0089; A63B 22/203; A63B 22/02–04; A63B 22/20–208; A63B 21/15–159; A63B 69/18; A63B 69/182; A63B 69/06; A63B 2069/062–068; A63B 21/22–227
See application file for complete search history.

(56) References Cited

U.S. PATENT DOCUMENTS 1,504,375 A * 8/1924 Phillips ..... A63B 22/0076 482/73
4,772,013 A * 9/1988 Tarlow, Jr. ..... A63B 22/0076 482/901
4,984,986 A * 1/1991 Vohnout ..... A63B 69/06 73/379.06
5,072,929 A * 12/1991 Peterson ..... A63B 22/0012 310/105
5,092,581 A * 3/1992 Koz ..... A63B 69/06 434/247

(Continued)

FOREIGN PATENT DOCUMENTS

GB 2583958 A * 11/2020 ..... A63B 21/00069

OTHER PUBLICATIONS

International Search Report from PCT/US2025/046798 dated Jan. 23, 2026 (4 pages).

(Continued)

*Primary Examiner* — Nyca T Nguyen
(74) *Attorney, Agent, or Firm* — Quarles & Brady LLP; James J. Aquilina

(57) ABSTRACT

An exercise device with alternative push and pull functionality is shown and described. The exercise device includes a frame assembly, a carriage assembly, and a resistance assembly which can work together to allow a user to engage in a leg-press exercise, an arm-press exercise, and an arm-pull exercise from a single position.

20 Claims, 9 Drawing Sheets

(56) References Cited

U.S. PATENT DOCUMENTS 5,094,446 A * 3/1992 Wiedner ..... A63B 21/0083 482/73
5,254,066 A * 10/1993 Brown ..... A63B 24/0062 601/40
5,496,236 A * 3/1996 Buonauito ..... A63B 21/1609 482/110
5,779,600 A * 7/1998 Pape ..... A63B 23/03533 482/73
5,928,116 A * 7/1999 Chiang ..... A63B 21/4047 482/133
5,989,163 A * 11/1999 Rodgers, Jr. ..... A63B 23/0417 482/52
6,042,516 A * 3/2000 Norton ..... A63B 22/205 482/54
6,168,554 B1 * 1/2001 Berg ..... A63B 69/06 482/138
6,569,065 B1 * 5/2003 Menold ..... A63B 22/0076 482/56
6,626,802 B1 * 9/2003 Rodgers, Jr. ..... A63B 22/0017 482/110
6,682,462 B1 * 1/2004 Lee ..... A63B 21/4043 482/62
7,115,077 B2 * 10/2006 Yang ..... A63B 22/0076 482/73
7,201,708 B2 * 4/2007 Dreissigacker .. A63B 21/00069 482/57
7,572,211 B2 * 8/2009 Roach ..... A63B 22/0076 482/51
7,731,637 B2 * 6/2010 D'Eredita ..... A63B 21/154 482/92
7,833,136 B2 * 11/2010 Bell ..... A63B 22/0076 482/138
7,862,484 B1 * 1/2011 Coffey ..... A63B 21/157 482/72
8,109,859 B2 * 2/2012 Medina ..... A63B 24/00 482/148
8,608,626 B2 * 12/2013 Campbell ..... A63B 21/05 482/72
8,777,817 B2 * 7/2014 Finestein ..... A63B 21/4045 482/93
9,005,086 B1 * 4/2015 O'Neil ..... A63B 22/0076 482/73
9,643,044 B1 * 5/2017 Hsu ..... A63B 21/0442
9,868,019 B2 * 1/2018 Lagree ..... A63B 21/023
9,974,996 B2 * 5/2018 Kiser ..... A63B 22/0076
10,449,410 B2 * 10/2019 Hamilton ..... A63B 21/008
10,486,016 B2 * 11/2019 Robert ..... A63B 21/153
10,675,500 B2 * 6/2020 Wang ..... A63B 23/03533
10,828,531 B1 * 11/2020 Smith ..... A63B 22/0076
11,013,952 B2 * 5/2021 French ..... A63B 21/0088
11,083,930 B1 * 8/2021 Tipple ..... A63B 22/0076
11,298,584 B2 * 4/2022 Wamser ..... A63B 22/0076
11,406,858 B2 * 8/2022 Villency ..... A63B 21/0626
11,413,494 B1 * 8/2022 Habing ..... A63B 21/225
11,420,090 B2 * 8/2022 Stepanian ..... A63B 21/4034
11,577,120 B1 * 2/2023 Carini ..... A63B 22/0087
11,794,067 B2 * 10/2023 Lammers ..... A63B 21/225
11,806,574 B2 * 11/2023 Janowski ..... A63B 69/0057
11,918,845 B2 * 3/2024 Hsu ..... A63B 22/0087
11,931,615 B2 * 3/2024 Lagree ..... A63B 21/00069
12,115,418 B2 * 10/2024 Lin ..... A63B 24/0087
2001/0008861 A1 * 7/2001 Dreissigacker .... A63B 21/0088 482/111
2004/0009849 A1 * 1/2004 Galbraith ..... A63B 22/0076 482/51
2005/0272568 A1 * 12/2005 Wang ..... A63B 22/0076 482/72
2006/0122042 A1 * 6/2006 Lundahl ..... A63B 21/225 482/110
2006/0264128 A1 * 11/2006 Osten ..... B63H 16/102 440/102
2008/0280736 A1 * 11/2008 D'Eredita ..... A63B 69/06 482/72
2011/0082015 A1 * 4/2011 Dreissigacker .. A63B 21/00069 482/72
2012/0100965 A1 * 4/2012 Dreissigacker .... A63B 22/0005 482/72
2013/0017934 A1 * 1/2013 Tayebi ..... A63B 21/4045 482/129
2013/0035216 A1 * 2/2013 Campbell ..... A63B 21/0552 482/72
2014/0087922 A1 * 3/2014 Bayerlein ..... A63B 21/00181 482/54
2014/0336011 A1 * 11/2014 Singh ..... A63B 22/0076 482/72
2016/0059060 A1 * 3/2016 Lagree ..... A63B 21/023 482/92
2016/0059061 A1 * 3/2016 Lagree ..... A63B 21/4035 482/92
2016/0107023 A1 * 4/2016 Campanaro ..... A63B 22/0076 482/72
2016/0279464 A1 * 9/2016 Liu ..... A63B 21/225
2017/0319889 A1 * 11/2017 Cei ..... A63B 21/0056
2018/0056117 A1 * 3/2018 Hamilton ..... A63B 69/06
2018/0056118 A1 * 3/2018 Bates ..... A63B 22/0087
2018/0169464 A1 * 6/2018 Janowski ..... A63B 21/0552
2018/0214734 A1 * 8/2018 Lammers ..... A63B 21/225
2019/0054343 A1 * 2/2019 Chiang ..... A63B 21/0435
2019/0262661 A1 * 8/2019 Stepanian ..... A63B 22/0076
2019/0336812 A1 * 11/2019 Leipheimer ..... A63B 23/03525
2020/0023231 A1 * 1/2020 Hsieh ..... A63B 22/0076
2020/0023232 A1 * 1/2020 French ..... A63B 22/0076
2020/0171337 A1 * 6/2020 Lagree ..... A63B 21/0407
2020/0188720 A1 * 6/2020 Villency ..... A63B 21/4031
2020/0206565 A1 * 7/2020 Stepanian ..... A63B 21/154
2021/0244996 A1 * 8/2021 Gearon ..... A63B 21/0084
2022/0111246 A1 * 4/2022 Ellis ..... A63B 22/205
2022/0143456 A1 * 5/2022 Lammers ..... A63B 21/154
2022/0193486 A1 * 6/2022 Lin ..... A63B 22/0076
2022/0203159 A1 * 6/2022 Sun ..... A63B 22/0089
2023/0105920 A1 * 4/2023 Neuhaus ..... A63B 24/0087 482/8
2023/0115159 A1 * 4/2023 Weller ..... A63B 22/0076 482/72
2024/0216750 A1 * 7/2024 Wang ..... A63B 22/0076

OTHER PUBLICATIONS

Written Opinion of the International Searching Authority from PCT/US2025/046798 dated Jan. 23, 2026 (5 pages).

* cited by examiner

EXERCISE DEVICE WITH ALTERNATIVE PUSH AND PULL FUNCTIONALITY

FIELD OF THE DISCLOSURE

The present disclosure relates to the field of exercise equipment, and more particularly to an exercise device with alternative push and pull functionality that allows a user to perform both push and pull exercises from a single position.

BACKGROUND

Rowing machines and other exercise devices are frequently used in gyms, homes, and other spaces for training and conditioning. In many of these devices, the motion of a user's arms, legs, or body is resisted by a weight, a rotating fan, or another resistance device.

In some rowing machines, for example, a user simulates a rowing cycle. In this cycle, a seat holding the user glides back and forth along a frame in response to the user applying force to a handle and a footrest. In some rowing machines, the resistance device moves back and forth on the frame in response to the forces.

In other exercise devices, for example, a user simulates an arm or chest press. In an arm or chest press, a user can work against a resisting force by pushing with their arms.

In still further exercise devices, for example, a user simulates a leg press. In a leg press, a user can work against a resisting force by pushing with their legs.

Existing exercise devices, such as those discussed above, often target a single movement or muscle group. As such, purchasing multiple pieces of gym equipment to enable a range of exercises can be expensive and take up large amounts of space. Accordingly, there is a need for exercise devices which allow a user to engage in multiple exercises on the same device.

SUMMARY OF THE INVENTIVE CONCEPTS

To address this need, an exercise device is provided that allows the user to perform both push (i.e., "press") and pull exercises from one seated position.

In one respect, the inventive concept is an exercise device comprising: a frame, the frame comprising a rail, the rail having an axis; a seat connected to the frame; a carriage assembly connected to the rail, the carriage assembly comprising a handle, the carriage assembly being alternatively adjustable between a first state of operation in which it is fixed in its position along the axis of the rail and a second state of operation in which it is slideable in its position along the axis of the rail; and a resistance assembly comprising a spool, a resistance element attached to the spool, a first cord connected between the carriage assembly and the spool, and a second cord connected between the spool and the carriage assembly; wherein in the first state of operation, the handle is adapted to be pulled in a direction generally towards the seat, causing the first cord to be unwound from the spool and the second cord to be wound around the spool, thereby causing the resistance element to apply resistance to the first cord; and wherein in the second state of operation, the carriage assembly is adapted to be pushed in a direction generally away from the seat, causing the first cord to be unwound from the spool and the second cord to be wound around the spool, thereby causing the resistance element to apply resistance to the first cord.

In another respect, the inventive concept is an exercise device comprising: a frame, the frame comprising a rail, the rail having an axis; a seat immovably connected to the frame; a carriage assembly connected to the rail, the carriage assembly comprising a pull handle and a braking mechanism, the braking mechanism being adjustable between a disengaged configuration wherein a position of the carriage assembly is adjustable along the axis of the rail and an engaged configuration wherein a position of the carriage assembly is fixable along the axis of the rail, and a resistance assembly comprising a spool, a resistance element attached to the spool, a first cord connected at a first end thereof to the carriage assembly on a top side of the rail and at a second end thereof to the spool, and a second cord connected at a first end thereof to the carriage assembly on a bottom side of the rail and at a second end thereof to the spool.

BRIEF DESCRIPTION OF THE DRAWINGS

The devices according to the present disclosure are further described with reference to the accompanying drawings, in which.

DETAILED DESCRIPTION

Figure 1:
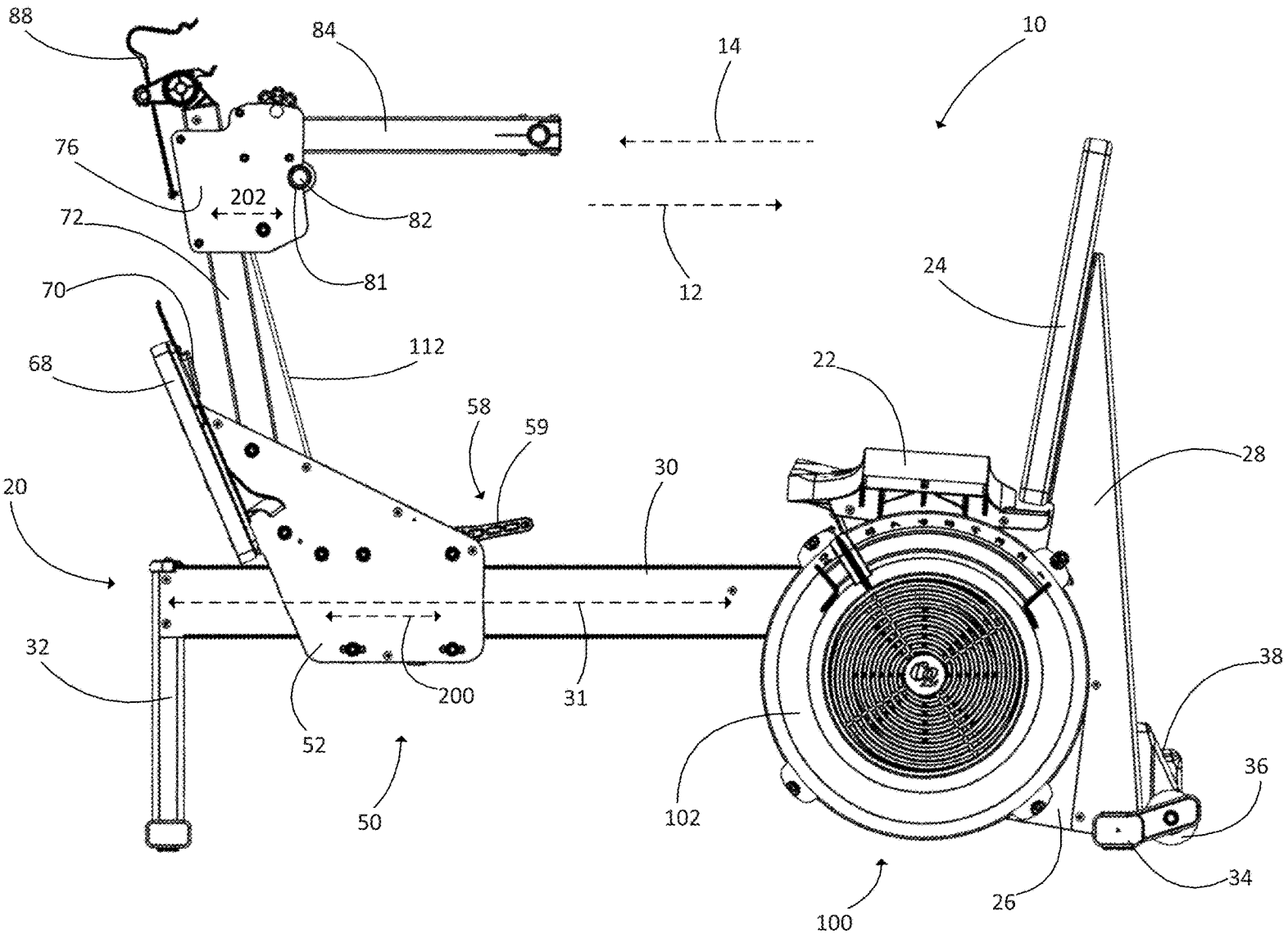
FIG. 1 is a first side view of an exercise device according to an embodiment of the present disclosure.

The ensuing detailed description provides exemplary embodiment(s) only, and is not intended to limit the scope, applicability, or configuration of the herein disclosed embodiment(s). Rather, the ensuing detailed description of the exemplary embodiment(s) will provide those skilled in the art with an enabling description for implementing the exemplary embodiments in accordance with the present disclosure. It should be understood that various changes may be made in the function and arrangement of elements without departing from the spirit and scope of the invention, as set forth in the appended claims.

To aid in describing the disclosure and/or invention as claimed, directional terms may be used in the specification and claims to describe portions of the present disclosure and/or invention (e.g., upper, lower, left, right, etc.). These directional definitions are merely intended to assist in describing the embodiment(s) and claiming the invention, and are not intended to limit the disclosure or claimed invention in any way. In addition, reference numerals that are introduced in the specification in association with a drawing figure may be repeated in one or more subsequent figures without additional description in the specification, in order to provide context for other features.

It should be understood that when an element is referred to as being "connected" or "coupled" to another element, it can be directly connected or coupled to the other element or that intervening elements may be present. In contrast, when an element is referred to as being "directly connected" or "directly coupled" to another element, it should be understood that no intervening elements are present. Other words used to describe the relationship between elements should be interpreted in a like fashion (e.g., "between" versus "directly between," "adjacent" versus "directly adjacent," etc.).

For purposes of the disclosure, the term "approximately parallel" means within a range of plus or minus 5 degrees from parallel, inclusive of an exact parallel arrangement.

For purposes of the disclosure, the term "approximately perpendicular" means within a range of plus or minus 5 degrees from perpendicular, inclusive of an exact perpendicular arrangement.

In embodiment(s) described herein or shown in the drawings, any direct electrical connection or coupling, i.e., any connection or coupling without additional intervening elements, may also be implemented by an indirect connection or coupling, i.e., a connection or coupling with one or more additional intervening elements, or vice versa, as long as the general purpose of the connection or coupling, for example, to transmit a certain kind of signal or to transmit a certain kind of information, is essentially maintained. Features from different embodiment(s) may be combined to form further embodiment(s). For example, variations or modifications described with respect to one of the embodiment(s) may also be applicable to other embodiment(s), unless noted to the contrary.

According to an embodiment of the invention, an exercise device is provided. The exercise device comprises a frame assembly, a carriage assembly, and a resistance assembly. These three assemblies work together and allow a user to engage in, without limitation, a leg-press exercise, an arm-press exercise, and an arm-pull exercise. In one embodiment of the present invention, the resistance assembly comprises a first cord, a second cord, a clutched spool, and a resistance element. One end of the first cord may be fixed to the clutched spool and is wound on the spool such that when the cord is pulled the clutch will engage the resistance element, thereby placing resistance on the first cord. The other end of the first cord may attach to a first handle, which is part of the carriage assembly. In the present embodiments, the first cord runs from the spool to the carriage assembly, around one or more pulleys, and attaches to the first handle. In alternative configurations, the first handle is able to be cradled in the carriage assembly in a way that it can act as if the first cord is "fixed" at that end (i.e., via the fixed location of the first handle) to the moving carriage assembly. Thus, when the first handle is cradled in the carriage assembly, moving the carriage assembly away from the spool will engage the resistance element. This is the operation during a leg press or arm press, both of which are loaded in the same direction relative to the user (i.e., when the carriage assembly is pressed in direction 14 generally away from the seat). If the carriage assembly is stationary and the first handle is instead taken out of the cradle and moved towards the user (i.e., pulled in direction 12 generally towards the seat), the first cord is pulled, engaging the resistance element. This is the same operation that is achieved during any of the movements in the opposite direction.

FIGS. 1-7 illustrate an exercise device 10 according to an embodiment of the present disclosure. In general, the exercise device 10 comprises a frame or frame assembly 20, a carriage assembly 50, and a resistance assembly 100. As shown, in FIGS. 1-7, frame assembly 20, carriage assembly 50, resistance assembly 100, and all the sub-assemblies and components of each assembly may be secured together via one or more of a variety of fastening mechanisms, including mechanical fasteners (pins, screws, bolts, plugs, rivets, etc.). Every component of exercise device 10 may be formed by casting, machining, three-dimensional printing, or other methodologies known in the art or hereafter derived.

Figure 2:
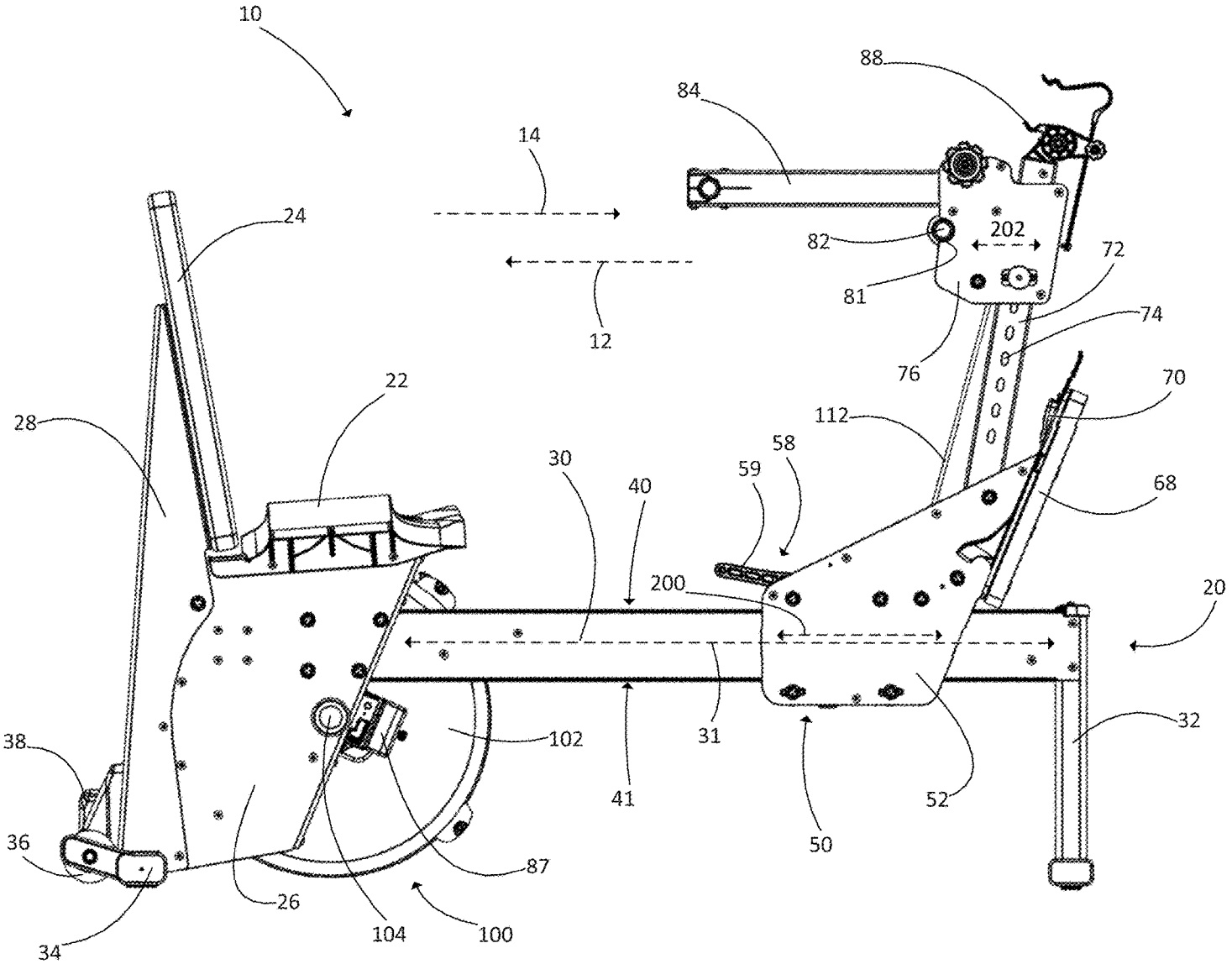
FIG. 2 is a second side view of the exercise device of FIG. 1.

With reference to FIGS. 1 and 2, exercise device 10 includes a frame assembly 20. Frame assembly 20 provides structure to exercise device 10 and facilitates the interaction of carriage assembly 50 with resistance assembly 100. Frame assembly 20 includes a seat 22, a back rest 24 adjacent to and that extends in a generally perpendicular direction from the seat 22, one or more first housing portions 26, one or more second housing portion 28, a rail 30, a first leg 32, and a second leg 34.

Rail 30 is connected to first leg 32 and first housings portions 26, and includes an axis 31 that in this embodiment is generally horizontal when the exercise device 10 is placed on a level (i.e., horizontal) support surface. First housing portions 26 are further connected to second housing portion 28 and seat 22. Second housing portion 28 is further connected to back rest 24, second leg 34, and handle holder 38. Second leg 34 is further includes wheels 36, which allow a user to easily tip the exercise device 10 upwardly onto the wheels and move exercise device 10 around on a support surface.

Figure 3:
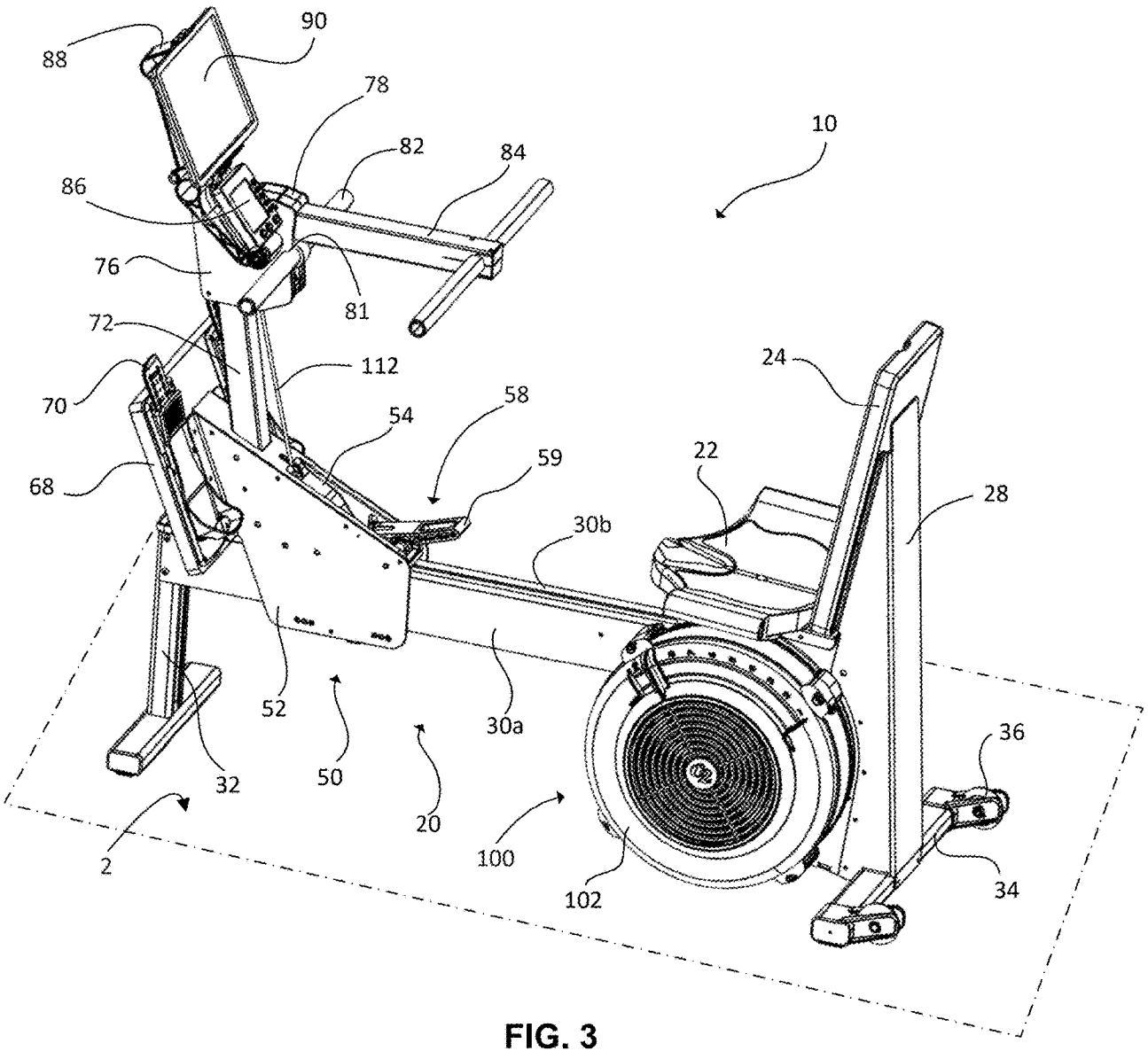
FIG. 3 is a first rear perspective view of an exercise device according to an embodiment of the present disclosure.
Figure 4:
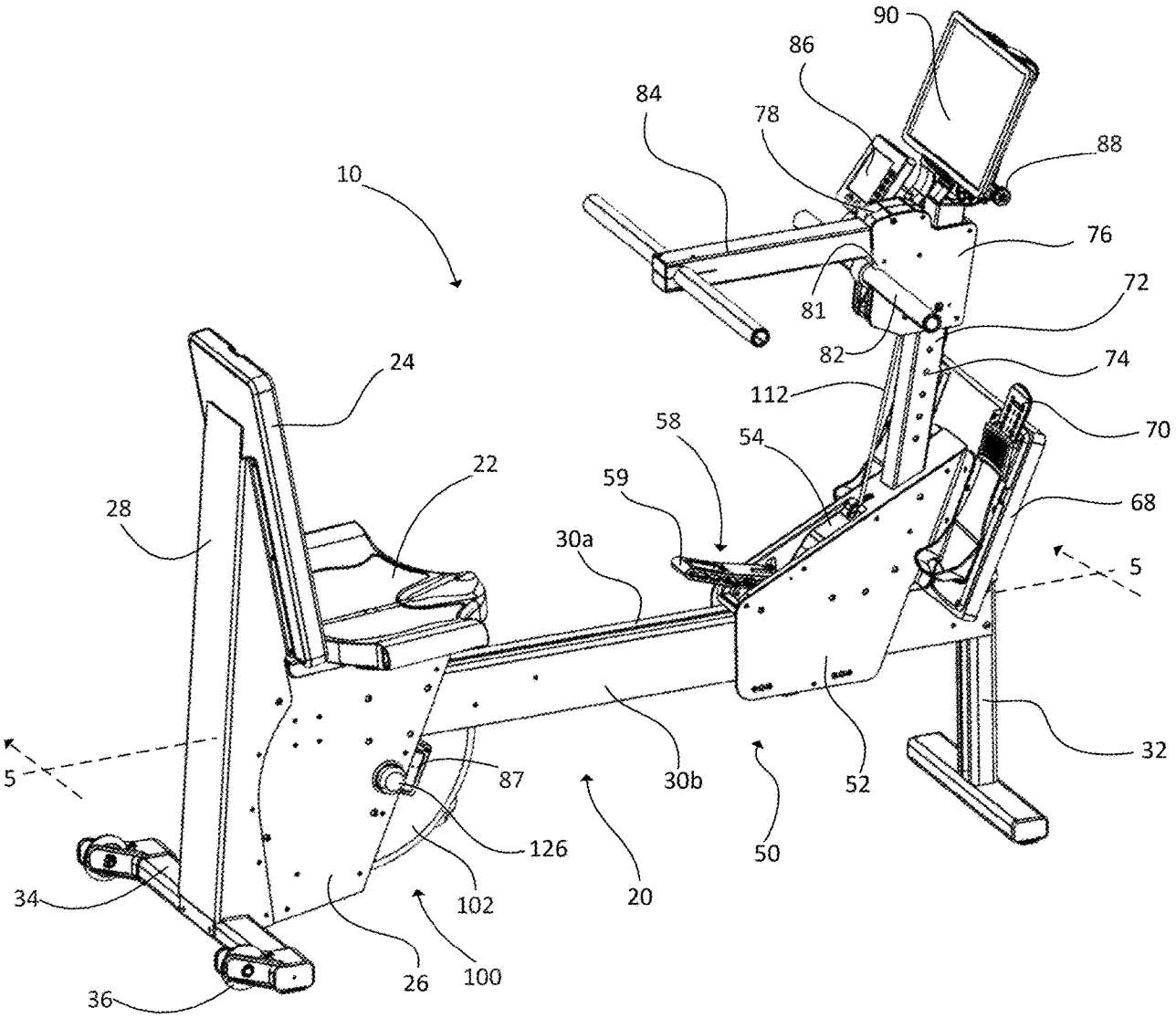
FIG. 4 is a second rear perspective view of the exercise device of FIG. 3.

In one embodiment, rail 30 may be split into one or more separate or connected rail portions, and generally has a top side 40 (toward the seat 22) and a bottom side 41 (toward a support surface). As shown in FIGS. 3 and 4, rail 30 is split into two rail portions 30*a*, 30*b* that extend along the axis 31. In some embodiments, rail 30 may comprise any number of individual rail portions.

Referring back to the Figures, in the present embodiments seat 22 and back rest 24 are fixed and immovable relative to the remainder of the frame assembly 20. In alternative embodiments, seat 22 and back rest 24 can be independently adjusted to optimize a user's comfort and engagement with exercise device 10.

In some embodiments of the invention, first housing portions 26 can be combined into a single housing portion. In other embodiments, first housing portions 26 can be combined with second housing portion 28 into a single housing portion or subassembly and/or may be comprised of any number of separate portions.

In some embodiments according to the present invention, first leg 32 and second leg 34 may each or both comprise a plurality of legs. First leg 32 and second leg 34 may also be of adjustable height to optimize a user's comfort and engagement with exercise device 10.

Still referring to FIGS. 1 and 2, carriage assembly 50 is slidably connected to rail 30 and can move forward and backward on an axis 31 of the rail 30 along an axis of movement 200, which is parallel to axis 31. Carriage assembly 50 includes a carriage housing 52 directly attached to the rail 30, a braking mechanism 58 located within the carriage housing 52, a foot platform 68, an upright portion 72 that extends upwardly from the carriage housing 52, a handle housing 76 attached to the opposing end of the upright portion 72, a first handle 82, a second handle 84, and, optionally, a device holder 88. Carriage reinforcement portions 54, braking mechanism 58, foot platform 68, and upright portion 72 are all attached to the carriage housing 52. Upright portion 72 is further connected to handle housing 76 and device holder 88. Handle housing 76 is connected to handle reinforcement portions 78 and can retain first handle 82 and second handle 84.

In some embodiments, handle housing 76 includes a notch 81 or other feature for retaining first handle 82 against handle housing 76 in certain modes of operation of the exercise device 10, as will be discussed in further detail below.

The braking mechanism 58 located in the carriage assembly 50 can be engaged or disengaged to fix or free, respectively, the movement of carriage assembly 50 along the axis 31 of the rail 30. When braking mechanism 58 is engaged, carriage assembly 50 is retained at a fixed position along the axis 31 of the rail 30. When braking mechanism 58 is disengaged, carriage assembly 50 can move freely along the axis 31 of the rail 30. In alternative embodiments, other suitable means for temporarily fixing the carriage assembly 50 along the axis 31 of the rail 30 may be used, such as a locking pin, screw(s), bolt(s), clamp(s), or other known or hereafter-derived mechanisms.

In the present embodiments, foot platform 68 includes foot mounts 70 or other suitable elements for retaining a user's foot on foot platform 68, such as foot pedals, shoe clips, toe cages, straps, or hook and loop fasteners. The location of the foot platform 68 may be adjustable relative to carriage housing 52. Foot platform 68 may, alternatively, be directly connected to upright portion 72 or any other part of carriage assembly 50. Foot mounts 70 may be adjustable on foot platform 68. Foot mounts 70 may also be independent of foot platform 68 and can be connected to carriage housing 52, carriage reinforcement portions 54, or any other part of carriage assembly 50. In alternative embodiments, the height, width, depth, and other dimensions of foot platform 68 may be different than those shown or adjustable.

In some embodiments, a position of the handle housing 76 can be adjusted along a length 73 of the upright portion 72 via a plurality of holes 74 located along length 73 of the upright portion 72. A locking pin, screw, bolt, or other mechanical fastener can engage with holes 74 to retain handle housing 76 at its desired position along the upright portion 72. In some embodiments, other suitable means for adjusting handle housing 76 on upright portion 72 can be used, such as a braking mechanism or other known or hereafter-derived mechanisms.

First handle 82 and second handle 84 are shown are shown in FIGS. 1 and 2 as having straight, cylindrical handle portions. In some embodiments, first handle 82 and second handle 84 may be interchangeable with alternative handles that can be curved, asymmetrical, or have different geometry. In alternative embodiments, first handle 82 and second handle 84 can be combined into a single handle, handle system, or handle assembly that enables a user to push and pull using the same handle.

In the present embodiments, first handle 82 is permanently connected to first cord 112 and second handle 84 is removably attachable to the carriage assembly 50 for arm press exercises. First cord 112 is part of resistance assembly 100. First handle 82 can move forward and backward parallel or approximately parallel to axis 202 when operated by a user (i.e., generally in directions 12 and 14). First handle 82 is also capable of vertical movement perpendicular or approximately perpendicular to axis 202. Second handle 84, when connected to handle housing 76, can also move parallel or approximately parallel to axis 202. In other embodiments, first handle 82 is not permanently connected to first cord 112. In still further embodiments, there is a magnetic system that allows a user to change first handle 82 and second handle 84 with alternative handles and/or second handle 84 could be permanently attached to carriage assembly 50 but rotatable or slideable out of the way for when only the first handle 82 will be used.

Still referring to FIGS. 1 and 2, resistance assembly 100 is operatively connected to carriage assembly 50 through frame assembly 20. Resistance assembly 100 includes a resistance element 102 that can provide resistance to the first cord 112, either against the movement of carriage 50 along rail 30 or directly against the free movement of first cord 112 at the first handle 82.

In some examples, the resistance element 102 includes a resistance fan or flywheel, for example, of the kind shown in U.S. Pat. No. 6,561,955, the entirety of which is incorporated herein by reference. In some implementations, the resistance device can be an electrical device or a friction device, for example. The resistance element 102 may be adjustable and allow the user to vary the amount of resistance incurred. In some embodiments that use an air resistance fan, the fan rotates on a spindle 104. In some embodiments, a spool assembly 106 is attached by a one-way clutch (not shown) to a spool axel 107. The one-way clutch enables the spool assembly 106 to rotate resistance element 102 when spool assembly 106 is driven in one rotational direction and allows the spool assembly 106 to rotate freely relative to the fan or flywheel when the spool assembly 106 is driven in the opposite rotational direction.

In other embodiments, resistance element 102 can comprise one or more a weight stacks affected by gravity, hydraulic cylinders, air, water or other fluid-powered fan, linear springs, torsional springs, gas springs, or any other known type of spring.

To engage in a leg press, a user sits on seat 22 and puts their feet in foot mounts 70 on foot platform 68. If braking mechanism 58 is disengaged, the user can use their legs to push carriage assembly 50 along the axis 31 of rail 30 in direction 14, thereby engaging resistance assembly 100 and resistance element 102. At the end of the range of motion, the carriage assembly 50 is moved back generally in direction 12.

To engage in an arm press exercise, a user inserts second handle 84 into handle housing 76 and secures second handle 84 in place via a locking dial, pin, or other known or hereafter-derived clamping means. If braking mechanism 58 is disengaged, the user can grab second handle 84 and use their arms to push carriage assembly 50 along the axis 31 of rail 30 in direction 14, engaging resistance assembly 100 and resistance element 102. At the end of the range of motion, the carriage assembly 50 is moved back generally in direction 12. The carriage assembly 50 may have a feature that is removable or adjustable and places a handle, bar, cord, or other element within reach of the user. During the arm press exercise, the user's feet can be placed, without limitation, either in foot mounts 70 or on a support surface (e.g., support surface 2 shown in FIG. 3 by dashed-dotted line) on which the exercise device 10 sits.

To engage in an arm pull exercise, a user should (if currently present) first remove the second handle 84 from the handle housing 76 and then secure carriage assembly 50 to rail 30 (i.e., in a fixed position along the axis 31 of the rail 30) with braking mechanism 58. Once carriage assembly 50 is secured to rail 30, the user may grab first handle 82 and pull first handle 82 to engage resistance assembly 100 and resistance element 102. At the end of the range of motion, resistance assembly 100 will pull first handle 82 away from the user, back towards carriage assembly 50. The carriage assembly 50 may have a feature that is removable or adjustable and places a handle, bar, cord, or other element within reach of the user. During the arm pull exercise, the user's feet can be placed, without limitation, either in foot mounts or on a support surface (e.g., support surface 2).

Exercise device 10 also allows a user to engage in a simultaneous arm pull and leg press exercise. During this movement, a user moves (i.e., pushes) carriage assembly 50 along the axis 31 of the rail 30 along its movement axis 200 (which is parallel with axis 31) generally away from the seat 22 (i.e., in direction 14) while simultaneously or sequentially pulling first handle 82 away from handle housing 76 and carriage assembly 50, i.e., generally towards the seat 22 (i.e., in direction 12).

Referring now to FIGS. 3 and 4, a very similar embodiment of the exercise device 10 is shown in perspective. Frame assembly 20, carriage assembly 50, and resistance assembly 100 as shown include the same elements previously discussed with respect to FIGS. 1 and 2. Additionally shown are one or more carriage reinforcement portions 54, one or more handle reinforcement portions 78, and an electronic display 86 (which may be, for example, a performance monitor, ergometer, or display with user interface capability).

Reinforcement portions 54, 78 provide internal structure to carriage assembly 50. Carriage reinforcement portions 54 may comprise any number of pieces. In one embodiment, carriage reinforcement portions 54 are connected to carriage housing 52 and foot platform 68. Carriage reinforcement portions 54 secure upright portion 72 to carriage assembly 50. Handle reinforcement portions 78 may comprise any number of pieces. In one embodiment, handle reinforcement portions 78 are connected to handle housing 76. In another embodiment, carriage reinforcement portions 54 can retain first handle 82 and second handle 84 in carriage assembly 50.

In this embodiment, electronic display 86 is connected to upright portion 72. In some embodiments, electronic display 86 and device holder 88 may be connected to handle housing 76, foot platform 68, carriage housing 52, or another portion of carriage assembly 50 or frame assembly 20.

In one embodiment, electronic display 86 is operatively connected to an electronics assembly 87. Electronics assembly 87 can include components that measure data relevant to a user's exercise session, process the data into useful statistics, and relay the collected data and statistics to electronic display 86 for the user to view or record. In other embodiments, the electronic display 86 is optional, and data collected by the electronics assembly 87 may be transmitted directly (via either a wired or wireless connection) to a user's device, for example device 90 as described below.

Device holder 88 (which is optionally included) may retain a device 90 (again optional, for example a tablet or smartphone) or other item that a user wishes to view or use during an exercise session. Electronics assembly 87 can also or alternatively be connected to device 90, either via a wired connection or wirelessly (e.g., through a Bluetooth connection) for delivery of data to the device 90. In alternative embodiments the device 90 can be used instead of the electronic display 86, or instead them may supplement each other in various ways.

Figure 5:
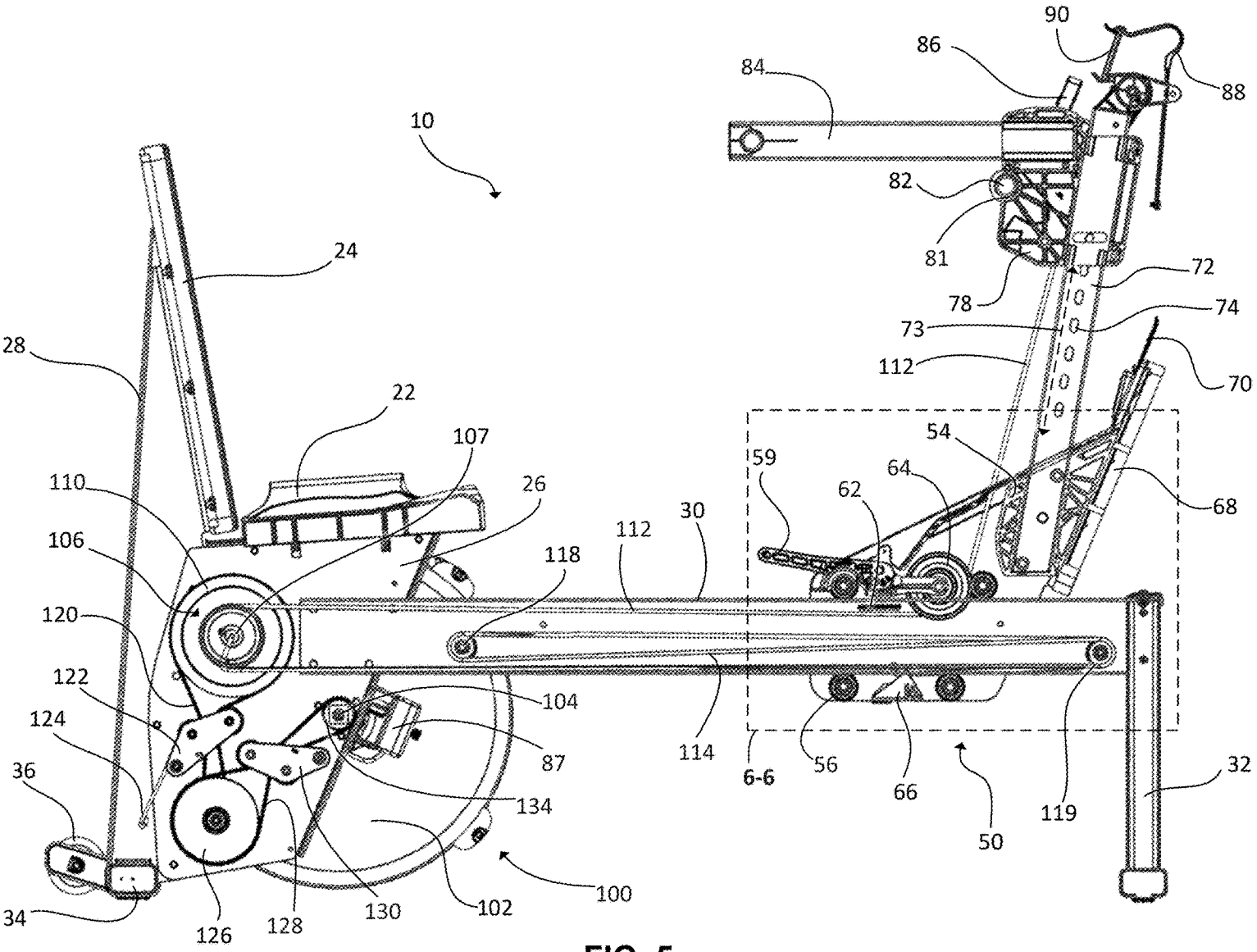
FIG. 5 is cross-sectional side view of the exercise device of FIG. 4, taken along line 5-5 of FIG. 4.

Referring now to FIG. 5, a cross-sectional view of the exercise device 10 of FIG. 4 along the line 5-5 is shown. In this view, the inside of frame assembly 20 and carriage assembly 50 is visible along with the components of resistance assembly 100.

Figure 6:
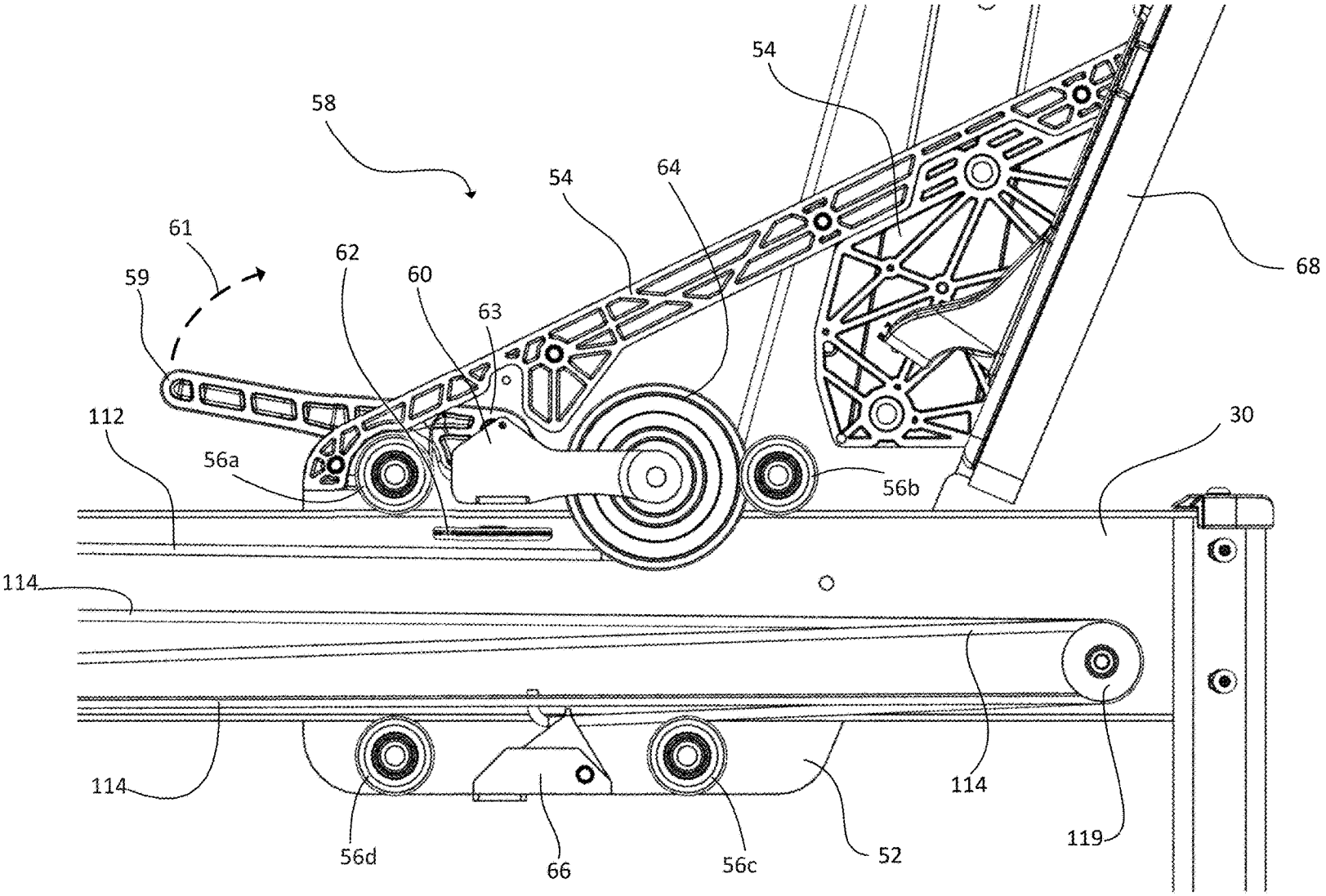
FIG. 6 is a close-up view of approximately the area indicated by 6-6 in FIG. 5.

Referring now to FIG. 6, a plurality of wheels 56*a*-56*d* are shown inside carriage assembly 50, which assist the movement of carriage assembly 50 along the axis 31 of rail 30. A carriage pulley 64 is shown which redirects and guides first cord 112 toward handle housing 76 (not shown in FIG. 6). A cord anchor 66 is also shown connected to carriage assembly 50. Cord anchor 66 retains one end of the second cord 114 on a bottom side 41 of the rail 30. Second cord 114 is part of resistance assembly 100.

Still referring to FIG. 6, a braking mechanism 58 of carriage assembly 50 is shown. Braking mechanism 58 includes a brake handle 59 comprising a cam portion 63, a brake arm 60, and a brake pad 62. Brake handle 59 is connected to brake arm 60 and brake pad 62, and brake arm 60 is connected at its opposite end to the carriage assembly 50. When braking mechanism 58 is engaged (as shown in the Figures), carriage assembly 50 is in an immovable configuration (i.e., fixed in a position along axis 200) along the axis 31 of the rail 30. When brake handle 59 is disengaged by rotating it in direction 61 shown in FIG. 6, the offset shape of the cam portion 63 of the brake handle 59 causes the brake arm 60 and brake pad 62 to move away from each other to release compression on the rail 30, while keeping the brake handle 59 in a fixed, upright position until a user rotates the brake handle 59 back to its engaged position (i.e., opposite the direction 61). When the braking mechanism 58 is engaged as shown in the Figures, the compression between brake arm 60 and brake pad 62 is sufficient to retain carriage assembly 50 in a fixed configuration (i.e., fixed position) along the axis 31 of the rail 30. When carriage assembly 50 is retained on rail 30, a user can engage in an arm pull exercise without carriage assembly 50 moving. In other embodiments of the invention, carriage assembly 50 can be retained at a desired position on rail 30 by any other type of known or hereafter-derived braking mechanism.

Figure 7:
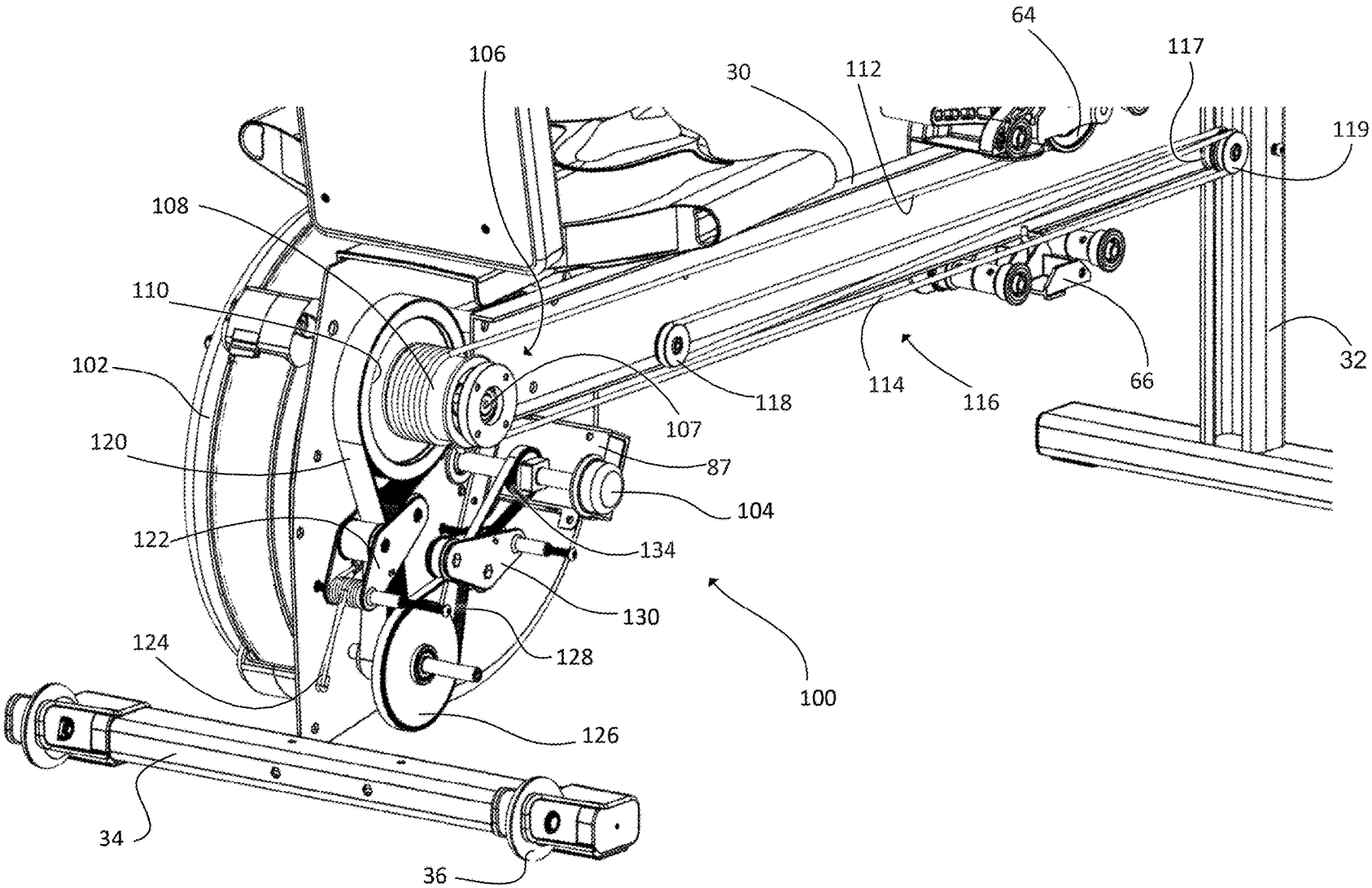
FIG. 7 is a rear perspective view of the exercise device of FIG. 3, showing internal components of the exercise device.

Referring now to FIG. 7, resistance assembly 100 of exercise device 10 is shown in perspective. Resistance assembly 100 includes: resistance element 102 attached to a spindle 104; a spool assembly 106 having a spool axle 107, a spool pulley 108, and a belt pulley 110; first cord 112; second cord 114; a frame pulley assembly 116 with a first frame pulley 117, a second frame pulley 118, and a third frame pulley 119; a first belt 120; a first belt tensioner 122 with a first torsion spring 124; a step pulley 126; a second belt 128; a second belt tensioner 130 with a second torsion spring 132; and a spindle pulley 134.

The mechanism of resistance assembly 100 is guided by the movement of first cord 112 and second cord 114, which are connected to spool assembly 106. Spool assembly 106 is operatively connected to resistance element 102 via spindle 104. Therefore, first cord 112 and second cord 114 are operatively coupled to resistance element 102. First and second cords 112, 114, may be cords, chains, cables, straps, belts, or ropes made of natural or synthetic material.

In the present embodiments, first cord 112 is a relatively rigid or inelastic material that functions as a drive belt, while the second cord 114 has elastic properties. First cord 112 is connected, at a first end, to carriage assembly 50 at first handle 82 (not shown in FIG. 7) which is alternatively separable from or retainable by handle housing 76 (not shown in FIG. 7). First cord 112 is guided from handle housing 76 toward a lower portion of carriage assembly 50 by a handle pulley 80 in handle housing 76. From there, carriage pulley 64 further guides first cord 112 through carriage assembly 50 and rail 30 toward spool assembly 106. A portion of first cord 112 is wrapped around spool pulley 108 of spool assembly 106. A second end of first cord 112 is fixedly connected to spool pulley 108. In alternative embodiments, the first end of first cord 112 can be connected to any part of carriage assembly 50 other than the first handle 82. In still further embodiments, the second end of first cord 112 can be fixedly connected to spool axle 107.

Second cord 114 is connected, at a first end, to carriage assembly 50 at cord anchor 66. Second cord 114 is guided through frame pulley assembly 116 which includes first frame pulley 117, second frame pulley 118, and third frame pulley 119. Second cord 114 is routed from cord anchor 66 around first frame pulley 117, then second frame pulley 118, and then third frame pulley 119. Third frame pulley 119 guides second cord 114 towards spool assembly 106. A portion of second cord 114 is wrapped around spool pulley 108 of spool assembly 106 in an opposite direction to first cord 112. A second end of second cord 114 is connected to spool pulley 108. In alternative embodiments, the first end of second cord 114 can be connected to any part of carriage assembly 50 and frame pulley assembly 116 can comprise any number of pulleys. In still further embodiments, the second end of first cord 114 can be fixedly connected to spool axle 107.

The routing of first cord 112 and second cord 114 create a balanced force on carriage assembly 50 such that there is no motion of carriage assembly 50 until carriage assembly 50 is activated by a user. In some embodiments of the present invention, any number of cords may be used or operatively connected to enable a user to engage in, without limitation, arm pull, arm/chest press, and leg press exercises.

Spool assembly 106 includes spool axle 107, spool pulley 108, and belt pulley 110. Spool assembly 106 further includes a one-way clutch which allows spool assembly 106 to engage resistance element 102 when spun in one rotational direction. Spool assembly 106 will rotate freely when spun in the opposite rotational direction.

First cord 112 and second cord 114 wrap around spool pulley 108 and are connected to spool axle 107. When spool axle 107 is spun, spool pulley 108 and belt pulley 110 may also spin. Belt pulley 110 is operatively connected to first belt 120. First belt 120 transfers the movement of belt pulley 110 to step pulley 126. Tension is maintained on first belt 120 by first belt tensioner 122 with first torsion spring 124.

Step pulley 126 engages with both first belt 120 and second belt 128. Second belt 128 transfers the movement of step pulley 126 to spindle pulley 134. Tension is maintained on second belt 128 by second belt tensioner 130 with second torsion spring 132. Spindle pulley 134 is connected to spindle 104 which is connected to resistance element 102.

In alternate embodiments of the present invention, any number of belts may be used between spool assembly 106 and resistance element 102. The number of belt tensioners can also be adjusted to optimize belt engagement with spool assembly 106 and the pulleys of resistance assembly 100. In alternative embodiments, first torsion spring 122 and second torsion spring 132 can be replaced with elastic cords (e.g., bungee cords) or other known or hereafter-derived mechanisms.

Figure 8A:
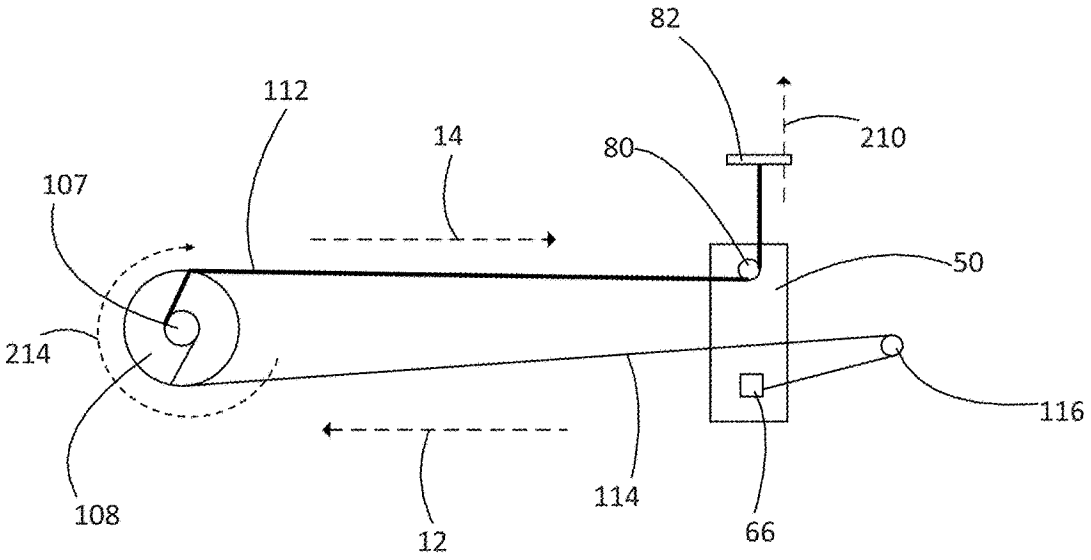
FIG. 8*a* is a schematic side view of a portion of a resistance assembly of an exercise device according to an embodiment of the present disclosure, during a concentric phase of an arm pull exercise.
Figure 8B:
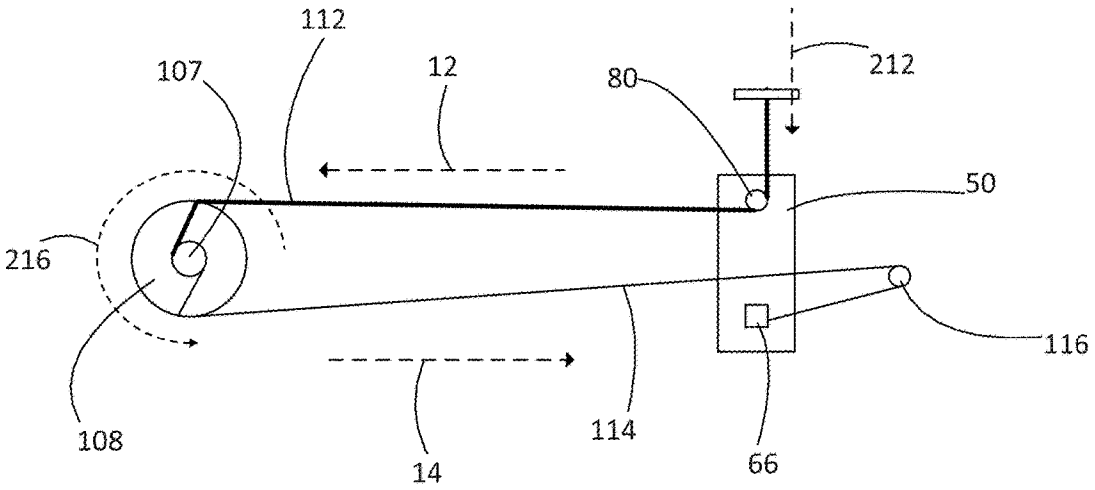
FIG. 8*b* is a schematic view of the exercise device of FIG. 8*a* during an eccentric phase of the arm pull exercise.

FIGS. 8*a* and 8*b* show a schematic view of the mechanism of exercise device 10 during an arm pull exercise (i.e., a first state of operation with carriage assembly 50 fixed to rail 30).

Referring now to FIG. 8*a*, the concentric phase of an arm pull exercise is shown. For the arm pull exercise, carriage assembly 50 is shown in a static position. During this motion, first handle 82 is moved from a resting position in a direction 210 away from carriage assembly 50. First handle 82 is connected to first cord 112, and the movement of first handle 82 moves first cord 112 generally in direction 14. First cord 112 is connected to spool axle 107 and wraps around spool pulley 108. Therefore, when first handle 82 is moved away from carriage 50, spool axle 107 and spool pulley 108 rotate in a first rotational direction 214. This rotation pulls additional amounts of second cord 114—which in the present embodiments has elastic properties—around spool pulley 108.

Referring now to FIG. 8*b*, the eccentric phase of the arm pull exercise of FIG. 8*a* is shown. After first handle 82 has reached its desired level of extension or a maximum extension, a user will relax their muscles and the elastic nature of second cord 114 will rotate spool axle 107 and spool pulley 108 in a second rotational direction 216, which is opposite to first rotational direction 214. As spool axle 107 rotates in direction 216, the excess portion of first cord 112 will be taken up by spool pulley 108 until first handle 82 is at its original resting position.

Figure 9A:
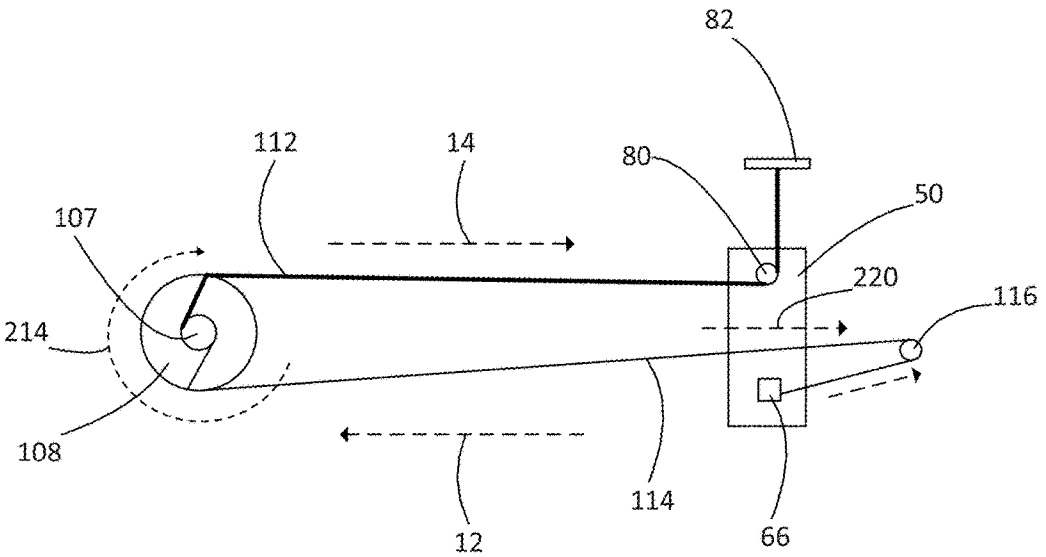
FIG. 9*a* is a schematic side view of a portion of a resistance assembly of an exercise device exercise according to an embodiment of the present disclosure, during a concentric phase of an arm press or leg press exercise.

Referring now to FIG. 9*a*, the concentric phase of an arm/chest press or leg press exercise is shown. For these exercises, first handle 82 is static while attached to the carriage assembly 50, but carriage assembly 50 itself is moved from a resting position in a direction 220 away from spool pulley 108 (i.e., the carriage assembly 50 is in a second state of operation free to move along rail 30). The movement of carriage assembly moves first cord 112. First cord 112 is connected to spool axle 107 and wraps around spool pulley 108. Therefore, when carriage assembly 50 is moved in direction 220, spool axle 107 and spool pulley 108 rotate in first rotational direction 214. Due to frame pulley assembly 116, the rotation of spool axle 107 and spool pulley 108 in the first rotational direction 214 pulls additional amounts of second cord 114—which in the present embodiments has elastic properties—around spool pulley 108.

Figure 9B:
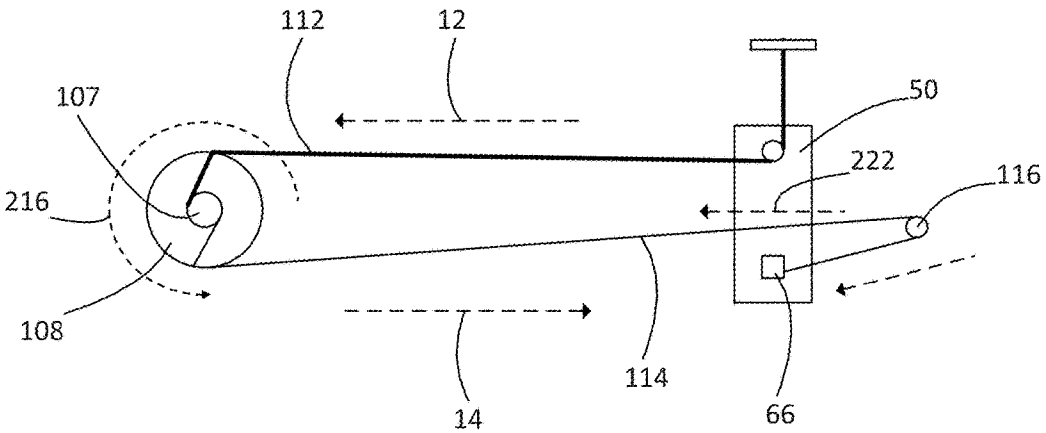
FIG. 9*b* is a schematic view of the exercise device of FIG. 9*a* during an eccentric phase of the arm press or leg press exercise.

Referring now to FIG. 9*b*, the eccentric phase of the arm/chest press or leg press exercise of FIG. 9*a* is shown. Once carriage assembly 50 has reached its desired level of extension or a maximum extension, a user will relax their muscles and return carriage assembly 50 to its original resting position. This movement will rotate spool axle 107 and spool pulley 108 in a second rotational direction 216, which is opposite to first rotational direction 214. As spool axle 107 rotates in direction 216, the excess cord of first cord 112 will be taken up by spool pulley 108 until carriage assembly 50 is at its original resting position.

Further, the arm pull exercise described in FIGS. 8*a* and 8*b* along with the leg press exercise described in FIGS. 9*a* and 9*b* can be simultaneously or sequentially performed to perform a rowing exercise. During the rowing exercise carriage assembly 50 moves as described in FIGS. 9*a* and 9*b* and first handle 82 moves as described in FIGS. 8*a* and 8*b*. Therefore, during the concentric phase of the rowing exercise, spool axle 107 and spool pulley 108 will move in a first rotational direction 214, letting out first cord 112 and taking up excess cord from second cord 114. During the eccentric phase of the rowing exercise, spool axle 107 and spool pulley 108 will move in a second rotational direction 216, taking up excess amounts of first cord 112 and letting out second cord 114.

In alternative embodiments according to the present invention, the spool assembly 106 could be replaced with a sprocket, for example a chain-driven sprocket. In these embodiments, a cord with elastic properties could be connected to the second end of the chain and engage with the carriage assembly, mutatis mutandis, in accordance with the detailed description above.

What is claimed is:

1. An exercise device comprising:

a frame, the frame comprising a rail, the rail having an axis;

a seat connected to the frame;

a carriage assembly connected to the rail, the carriage assembly comprising a handle, the carriage assembly being alternatively adjustable between a first state of operation in which it is fixed in its position along the axis of the rail and a second state of operation in which it is slideable in its position along the axis of the rail; and a resistance assembly comprising a spool, a resistance element attached to the spool, a first cord connected between the carriage assembly and the spool, and a second cord connected between the spool and the carriage assembly;

wherein in the first state of operation, the handle is adapted to be pulled in a direction generally towards the seat, causing the first cord to be unwound from the spool and the second cord to be wound around the spool, thereby causing the resistance element to apply resistance to the first cord; and wherein in the second state of operation, the carriage assembly is adapted to be pushed in a direction generally away from the seat, causing the first cord to be unwound from the spool and the second cord to be wound around the spool, thereby causing the resistance element to apply resistance to the first cord.

2. The exercise device of claim 1, the first cord being comprised of a rigid material and the second cord being comprised of an elastic material.

3. The exercise device of claim 1, wherein a first end of the first cord is attached to the carriage assembly on a top side of the rail and a second end of the first cord is attached to the spool, and wherein a first end of the second cord is attached to the carriage assembly on a bottom side of the rail and a second end of the second cord is attached to the spool.

4. The exercise device of claim 1, the seat being immovable in relation to the frame.

5. The exercise device of claim 1, the resistance element comprising a flywheel.

6. The exercise device of claim 5, wherein the flywheel generates resistance via movement of air through the flywheel.

7. The exercise device of claim 5, the resistance element further comprising a spindle connected to the flywheel and at least one belt connected between the spindle and the spool.

8. The exercise device of claim 1, the carriage assembly further comprising a braking mechanism, the carriage assembly being fixable in its position along the axis of the rail via engagement of the braking mechanism with the rail.

9. The exercise device of claim 8, the braking mechanism comprising a brake arm and a brake pad, wherein the brake arm and brake pad are movable towards each other to engage the braking mechanism with the rail, and wherein the brake arm and the brake pad are movable away from each other to disengage the braking mechanism from the rail.

10. The exercise device of claim 1, wherein the handle is a first handle that is capable of being pulled away from the carriage assembly and generally towards the seat, the exercise device comprising a second handle that is rigidly attachable to the carriage assembly, the second handle being pressable to move the carriage assembly in a direction generally away from the seat.

11. The exercise device of claim 1, wherein the carriage assembly further comprises a foot platform.

12. The exercise device of claim 11, wherein in the first state of operation, the carriage assembly is configured to be pushed via the foot platform to move it in a direction generally away from the seat while the handle is being pulled in the direction generally towards the seat.

13. The exercise device of claim 1, the exercise device further comprising a first leg and a second leg that support the axis of the rail in a generally horizontal configuration when the exercise device is placed on a horizontal support surface.

14. The exercise device of claim 1, further comprising a back rest adjacent to the seat.

15. The exercise device of claim 1, wherein the carriage assembly includes a carriage housing directly attached to the rail, a handle housing, and an upright portion attached between the carriage housing and the handle housing, the first cord being routed through the carriage assembly and the handle housing and extending out of the handle housing to attach to the handle.

16. The exercise device of claim 15, wherein a position of the handle housing is adjustable along a length of the upright portion.

17. The exercise device of claim 15, wherein the handle housing includes a notch in which the handle is configured to be removably retained.

18. The exercise device of claim 17, wherein in the second state of operation, the notch fixes a position of the handle relative to the handle housing, such that movement of the carriage assembly along the axis of the rail moves the handle along with the remainder of the carriage assembly.

19. An exercise device comprising:

a frame, the frame comprising a rail, the rail having an axis;

a seat immovably connected to the frame;

a carriage assembly connected to the rail, the carriage assembly comprising a pull handle and a braking mechanism, the braking mechanism comprising a brake arm and a brake pad, wherein the brake arm and the brake pad are adjustable between a disengaged configuration wherein a position of the carriage assembly is adjustable along the axis of the rail and an engaged configuration wherein a position of the carriage assembly is fixable along the axis of the rail, and a resistance assembly comprising a spool, a resistance element attached to the spool, a first cord connected at a first end thereof to the carriage assembly on a top side of the rail and at a second end thereof to the spool, and a second cord connected at a first end thereof to the carriage assembly on a bottom side of the rail and at a second end thereof to the spool.

20. The exercise device of claim 19, the first cord being comprised of a rigid material and the second cord being comprised of an elastic material.

* * * * *